United States Patent [19]

Disch et al.

[11] Patent Number: 4,666,615

[45] Date of Patent: May 19, 1987

[54] AQUEOUS LIQUID CLEANER CONTAINING AN ANIONIC SURFACTANT AND AN ETHOXYLATED ALIPHATIC VICINAL HYDROXYAMINE

[75] Inventors: Karlheinz Disch, Haan; Eva Kiewert, Duesseldorf, both of Fed. Rep. of Germany

[73] Assignee: Henkel Kommanditgesellschaft auf Aktien, Duesseldorf, Fed. Rep. of Germany

[21] Appl. No.: 766,610

[22] Filed: Aug. 16, 1985

[30] Foreign Application Priority Data

Aug. 23, 1984 [DE] Fed. Rep. of Germany ..... 3431003

[51] Int. Cl.[4] ..... C11D 1/44; C11D 1/65; C11D 1/83; C11D 17/08

[52] U.S. Cl. ..... 252/11; 252/110; 252/117; 252/121; 252/139; 252/153; 252/173; 252/529; 252/535; 252/539; 252/548; 252/554; 252/558; 252/DIG. 14

[58] Field of Search ..... 252/529, 548, 539, 540, 252/558, 559, 173, DIG. 14, 110, 111, 117, 139, 153

[56] References Cited

U.S. PATENT DOCUMENTS

| | | | |
|---|---|---|---|
| 3,296,146 | 1/1967 | Meyers | 252/548 |
| 3,697,423 | 10/1972 | Sundby | 252/8.8 |
| 3,741,912 | 6/1973 | Kaneko | 252/529 |
| 4,171,278 | 10/1979 | Andree | 252/102 |
| 4,175,062 | 11/1979 | Disch | 252/540 |
| 4,264,480 | 4/1981 | Andree | 252/548 |

FOREIGN PATENT DOCUMENTS

| | | |
|---|---|---|
| 1941256 | 2/1970 | Fed. Rep. of Germany . |
| 1904941 | 8/1970 | Fed. Rep. of Germany . |
| 2703020 | 8/1977 | Fed. Rep. of Germany . |
| 2709690 | 1/1979 | Fed. Rep. of Germany . |

*Primary Examiner*—Dennis L. Albrecht

*Attorney, Agent, or Firm*—Ernest G. Szoke; Henry E. Millson, Jr.; Real J. Grandmaison

[57] ABSTRACT

A composition of matter, preferably a liquid cleaning preparation for hard surfaces, comprising from 1 to 30, preferably 2 to 30, parts by weight of:

(a) adducts of ethylene oxide, preferably from 3 to 20 moles, with aliphatic hydroxyamines, preferably vicinal internal or terminal hydroxyamines, having a linear alkyl chain ($C_{10-20}$) and containing from 1 to 4 carbon atoms in the alkylamine residue; and (b) linear alkylaryl, preferably alkylbenzene, sulfonates or alkane sulfonates wherein (a) and (b) are in a ratio of from 1:1 to 1:18. The liquid preparation may contain water and other suitable cleaning ingredients.

2 Claims, No Drawings

AQUEOUS LIQUID CLEANER CONTAINING AN ANIONIC SURFACTANT AND AN ETHOXYLATED ALIPHATIC VICINAL HYDROXYAMINE

FIELD OF THE INVENTION

This invention relates to a composition of matter, preferably in the form of a liquid preparation in the form of a more or less dilute, more preferably aqueous, solution. The composition of matter contains nonionic adducts of ethylene oxide with aliphatic hydroxyamines having a linear $C_{10-20}$ alkyl chain and anionic surfactants. The composition of matter can optionally be combined with other standard ingredients and is particularly useful for cleaning hard surfaces.

DESCRIPTION OF THE RELEVANT ART

Fabric detergents which are particularly suitable for low-temperature washing and which, in addition to at least one surfactant from the group anionic, nonionic and zwitter-ionic surfactants, contain nonionic adducts of ethylene oxide with aliphatic hydroxyamines having a linear $C_{10-20}$ alkyl chain, are disclosed in German Offenlegungsschrift No. 27 03 020. There is, however, no reference in this German patent document to the possible use of these detergents in other fields and thus no teaching as to certain surfactant combinations in certain quantities and quantitative ratios.

German Patentschrift No. 2 709 690 describes liquid cleaners for hard surfaces in kitches, bathrooms, cellars, etc., which contain certain quantities of nonionic adducts of ethylene oxide with aliphatic vicinal internal or terminal diols or monoalkylethers thereof and linear alkylbenzene sulfonic acids and/or linear alkane sulfonic acids or water-soluble salts thereof. It was, nonetheless, surprising to find that certain combinations of ethoxylated hydroxyamines and alkylaryl sulfonates and/or alkane sulfonates as anionic surfactants have a synergistic cleaning effect, which surpasses the effect of the individual components used in the same quantities to an unexpected degree. The invention thus offers a valuable alternative to the known surfactant combinations.

SUMMARY OF THE INVENTION

A composition of matter is provided containing from 1 to 30, preferably 2 to 30, parts by weight of a combination of (a) at least one nonionic adduct of from 3 to 20, preferably from 5 to 12, moles of ethylene oxide with at least one aliphatic hydroxyamine having a linear alkyl chain containing from 10 to 20, preferably from 11 to 18, carbon atoms and an alkylamine residue containing from 1 to 4 carbon atoms and (b) at least one anionic surfactant selected from the group consisting of linear alkylaryl, preferably alkylbenzene, sulfonic acids containing from 8 to 20 carbon atoms in the alkyl residue, linear alkane sulfonic acids containing from 8 to 20 carbon atoms in the alkyl residue and water-soluble alkali, alkaline earth and ammonium salts thereof. The ratio of (a) to (b) is preferably from about 1:1 to 1:18, more preferably from about 1:2 to 1:9. Preferably, the composition of matter is provided in the form of a liquid preparation.

DETAILED DESCRIPTION OF THE INVENTION

The composition of matter of the present invention preferably contains from about 1 to 30 parts by weight, more preferably from about 5 to 15 parts by weight, of a combination of (a) and (b). The aliphatic hydroxyamines recited in (a) are preferably vicinal internal or terminal hydroxyamines. Preferably, the composition of matter is in the form of a liquid and contains from about 1 to 30%, preferably about 2 to 30%, more preferably from about 5 to 15%, by weight, of the combination of (a) and (b).

The non-ionic adducts useful in the present invention are preferably prepared in a known manner by reacting relatively high molecular weight terminal or internal epoxyalkanes having a linear $C_{10-20}$, preferably $C_{10-15}$ alkyl chain with 1 mole of diethanolamine to form a hydroxyamine and subsequently adding from 3 to 20 moles, preferably from 5 to 12 moles, of ethylene oxide, preferably at elevated temperatures of from about 50° to 200° C. and under either normal or elevated pressure. The reaction is generally accelerated by basic or acidic catalysts.

The epoxyalkanes used as starting materials for production of the hydroxyamines may be obtained in known manner from the corresponding olefins or olefin mixtures. The alpha- or 1,2-epoxyalkanes may be obtained via alpha-monoolefins which in turn may be obtained, for example, by polymerization of ethylene with organic aluminium compounds as catalysts or by thermal cracking of paraffin wax. Preferred terminal monoolefins are those having chain lengths of from 10 to 18 carbon atoms.

The internal epoxyalkanes may be obtained, for example, by epoxidation of linear aliphatic $C_{10-20}$ olefins containing an internal, statistically distributed double bond using per-acids or hydrogen peroxide and lower carboxylic acids which form per-acids or also by epoxidation of olefin mixtures which have been obtained by catalytic dehydrogenation or by chlorination/dehydrochlorination of linear paraffins and selective extraction of the monoolefins.

Monoolefins containing an internal double bond may also be produced by isomerization of alpha-olefins. The alpha-olefins used as starting material are preferably those wherein the double bond is situated substantially in the middle of the carbon atom chain.

Preferred internal monoolefins of a $C_{11-14}$ fraction with a statistically distributed double bond have the following chain length distribution:

$C_{11-14}$ fraction:

- $C_{11}$ olefins, approximately 22% by weight
- $C_{12}$ olefins, approximately 30% by weight
- $C_{13}$ olefins, approximately 26% by weight
- $C_{14}$ olefins, approximately 22% by weight.

Preferred terminal monoolefins have the following chain-length distribution:

$C_{12-14}$ fraction:

- $C_{12}$ olefins, approximately 70% by weight
- $C_{14}$ olefins, approximately 30% by weight.

Preferred alkylaryl sulfonates and alkali, alkaline earth and ammonium salts thereof are those wherein the alkyl residue contains from 10 to 18, more particularly, from 11 to 14 carbon atoms, in a linear chain. Representative examples include sodium dodecylbenzene sulfonate, ammonium dodecyl sulfonate, sodium tridecylbenzene sulfonate, magnesium dodecylbenzene sulfonate, sodium tetradecylbenzene sulfonate, ammonium dodecyl toluene sulfonate, lithium pentadecylbenzene sulfonate, sodium dioctylbenzene sulfonate, disodium dodecylbenzene disulfonate, disodium diisopropylnaphthyl naphthalene disulfonate and the like. The sodium salts of alkylbenzene sulfonic acids are preferred. However, the alkylaryl sulfonates may be at least partly replaced by the free alkylaryl, preferably alkylbenzene, sulfonic acids and neutralization may be brought about in situ, for example by the addition of ammonia in a suitable quantity.

The alkali, alkaline earth and ammonium salts of the alkane sulfonic acids are preferably those containing a secondary sulfonic acid group and a linear $C_{8-20}$, more particularly $C_{12-18}$, alkyl chain. The ammonium, potassium and sodium salts are most preferred. Once again, the salts may be partly replaced by free alkane sulfonic acids and subsequent neutralization brought about by the addition of alkalis or ammonia in the appropriate quantity.

The advantageous properties of the claimed cleaner combination can be provided even when they are used without any other additions. They may, of course, also be used together with other ingredients common to cleaners of the type in question, as explained below.

Inorganic or organic compounds showing a totally alkaline reaction, preferably inorganic or organic complexing agents in the form of their alkali or amine salts and more preferably their potassium salts, are used as builders for the liquid cleaners according to the invention. Representative builders include alkali hydroxides, preferably potassium hydroxide.

Particularly suitable inorganic complexing builders are alkaline-reacting polyphosphates, more particularly tripolyphosphates, and also pyrophosphates. They may be completely or partly replaced by organic complexing agents.

Other inorganic builders which may be used in accordance with the invention are, for example, the bicarbonates, carbonates, borates, silicates or orthophosphates of the alkali metals.

Organic complexing agents of the aminopolycarboxylic acid type include inter alia nitrilotriacetic acid, ethylene diamine tetraacetic acid, N-hydroxyethyl ethylene diamine triacetic acid, and polyalkylene-polyamine-N-polycarboxylic acids. Examples of di- and polyphosphonic acids are methylene diphosphonic acid, 1-hydroxyethane-1,1-disphosphonic acid, propane-1,2,3-triphosphonic acid, butane-1,2,3,4-tetraphosphonic acid, polyvinyl phosphonic acid, copolymers of vinyl phosphonic acid and acrylic acid, ethane-1,2-dicarboxy-1,2-diphosphonic acid, ethane-1,2-dicarboxy-1,2-dihydroxydiphosphonic acid, phosphonosuccinic acid, 1-aminoethane-1,1-diphosphonic acid, amino-tri-(methylenephosphonic acid), methylamino- or ethylamino-di-(methylenephosphonic acid) and ethylenediamine-tetra-(methylenephosphonic-acid).

Various polycarboxylic acids, generally nitrogen or phosphorus free, have recently been proposed as builders, often, but not always, for polymers containing carboxyl groups. Many of these polycarboxylic acids are capable of complexing calcium.

Such polycarboxylic acids may be used in the invention and include, for example, citric acid, tartaric acid, benzene hexacarboxylic acid, tetrahydrofuran tetracarboxylic acid, etc. It is also possible to use polycarboxylic acids containing carboxymethyl ether groups, such as for example diglycolic acid, 2,2'-oxydisuccinic acid, polyfunctional alcohols or hydroxycarboxylic acids partly or completely etherified with glycolic acid, such as for example bis-(O-carboxymethyl)-ethylene glycol, bis-(O-carboxymethyl)-diethylene glycol, 1,2-bis-(O-carboxymethyl)-glycerin, tris-(O-carboxymethyl)-glycerin, mono- or bis-(O-carboxymethyl)-glyceric acid, mono- or bis-(O-carboxymethyl)-tartaric acid, mono-(O-carboxymethyl)-erythronic acid, tris-(O-carboxymethyl)-2,2-dihydroxymethyl propanol, tris-(O-carboxymethyl)-2,2-dihydroxymethyl butanol, mono-(O-carboxymethyl)-trihydroxy glutaric acid, bis-(O-carboxymethyl)-trihydroxy glutaric acid or carboxymethylated or oxidized polysaccharides.

Examples of polycarboxylic acids of the polymer type are poly-alpha-hydroxyacrylic acid, maleic acid-tetrahydrofuran copolymers, polymers of maleic acid, itaconic acid, mesaconic acid, fumaric acid, aconitic acid, methylene malonic acid and citraconic acid and also copolymers of these acids with one another or with other polymerizable compounds, such as for example ethylene, propylene, acrylic acid, methacrylic acid, crotonic acid, 3-butene carboxylic acid, 3-methyl-3-butene carboxylic acid and also vinylmethylether, vinyl acetate, isobutylene, acrylamide and styrene.

The substantially uncross-linked polyhydroxycarboxylic acids and polyformyl carboxylic acids which contain predominantly linear C-C-bonds in the main chain and which consist essentially of ethylene units each containing a carboxyl, formyl, hydroxymethyl or hydroxyl group, are also obtained by polymerization. Representative polyhydroxycarboxylic acids have a ratio of carboxyl groups to hydroxyl groups of from 1.1 to 15, preferably from 2 to 9, and a degree of polymerization of preferably from 3 to 600. They may be obtained, for example, by copolymerization of acrolein and acrylic acid in the presence of hydrogen perioxide, followed by Cannizzaro's reaction (German Offenlegungsschrift No. 19 04 941).

Representative polyformyl carboxylic acids have a ratio of carboxyl to formyl groups of at least 1 and a degree of polymerization of preferably from about 3 to 100. The polymers may optionally contain terminal hydroxyl groups. They may be produced, for example, by the oxidative polymerization of acrolein with hydrogen peroxide (German Offenlegungsschrift No. 19 42 256).

In general, domestic cleaners are substantially neutral to mildly alkaline, i.e. their aqueous in-use solutions have a pH-value ranging from about 7.0 to 10.5, preferably from about 7.5 to 9.5, for concentrations of from about 2 to 20, preferably from about 5 to 15, g/l of water or aqueous solution. An addition of acidic or alkaline components may be necessary to maintain an appropriate pH-value.

Suitable acidic components are the usual inorganic or organic acids or acidic salts, such as for example hydrochloric acid, sulfuric acid, bisulfates of the alkali metals, aminosulfonic acid, phosphoric acid or other acids of phosphorus, particularly the anhydrous acids of phosphorus or acidic salts or acid-reacting solid compounds thereof with urea or other lower carboxylic acid amides, partial amides of phosphoric acid or of anhydrous phosphoric acid, citric acid, tartaric acid, lactic acid and the like.

In addition, inorganic or organic colloids or other water-soluble high molecular weight substances may be used as additives. Representative additives of this type include inter alia polyvinyl alcohol, polyvinyl pyrrolidone, water-soluble derivatives of cellulose or of starch, such as carboxymethyl cellulose, ethers of cellulose and oxyalkyl sulfonic acids and also cellulose sulfates.

In addition, it is possible to incorporate known solution promoters, which include the water-soluble organic solvents, such as low molecular weight aliphatic alcohols containing from 1 to 4 carbon atoms, and also the so-called hydrotropic substances of the lower aryl sulfonate type, for example toluene, xylene or cumene sulfonate. They may also be present in the form of their sodium and/or potassium and/or alkylolamine salts.

Other suitable solution promoters are water-soluble organic solvents, particularly those having boiling points above 75° C., such as, for example, the ethers of identical or different polyhydric alcohols or the partial ethers of polyhydric and monohydric alcohols. Solution promoters such as these include, for example, di- or triethylene glycol polyglycerols and also the partial ethers of ethylene glycol, propylene glycol, butylene glycol or glycerol with aliphatic monohydric alcohols containing from 1 to 4 carbon atoms in the molecule.

Suitable water-soluble or water-emulsifiable organic solvents are ketones, such as acetone and methylethyl ketone, aliphatic, cycloaliphatic, aromatic and chlorinated hydrocarbons and also the terpene alcohols.

To regulate viscosity, it may be advisable to add higher polyglycol ethers or polyglycerol or other water-soluble high molecular weight compounds of the type also known as soil suspending agents. In addition, it is advisable to add sodium chloride and/or urea to regulate viscosity.

In addition, the claimed preparations may contain dyes and perfumes, preservatives and, if desired, even antibacterial agents.

Suitable antimicrobial agents are compounds which are stable and active in the liquid preparations according to the invention. The compounds in question are preferably phenolic compounds of the halogenated phenol type containing from 1 to 5 halogen substituents, particularly chlorinated phenols; alkyl, cycloalkyl, aralkyl and phenyl phenols containing from 1 to 12 carbon atoms in the alkyl residues and from 1 to 4 halogen substituents, particularly chlorine and bromine, in the molecule; alkylene bisphenols, particularly derivatives substituted by 2 to 6 halogen atoms and, optionally, lower alkyl or trifluoromethyl groups and containing a $C_{1-10}$ alkylene bridge member; hydroxybenzoic acids or esters and amides thereof, particularly anilides, which may be substituted in the benzoic acid and/or aniline residue, in particular by 2 or 3 halogen atoms and/or trifluoromethyl groups; orthophenoxyphenols which may be substituted by from 1 to 7, preferably from 2 to 5, halogen atoms and/or by hydroxyl, cyano, methoxycarbonyl and carboxyl or lower alkyl groups. Particularly preferred antimicrobial agents of the phenyl type are, for example, O-phenylphenol, 2-phenylphenol, 2-hydroxy-2',4,4'-tri-chlorodiphenyl ether, 3,4',5-tribromosalicylanilide and 3,3',5,5',6,6'-hexachloro-2,2'-dihydroxydiphenylmethane.

Other suitable antimicrobial agents are lower $C_{3-5}$ alcohols and diols substituted both by bromine and by nitro groups, such as the compounds 2-bromo-2-nitropropane-1,3-diol, 1-bromo-1-nitro-3,3,3-trichloro-2-propanol, 2-bromo-2-nitro-1-butanol.

Bis-diguanides, such as for example 1,6-bis-(p-chlorophenyldiguanido)-hexane in the form of the hydrochloride, acetate or gluconate, N,N'-disubstituted 2-thiontetrahydro-1,3,5-thiadiazines such as, for example, 3,5-dimethyl, 3,5-diallyl, 3-benzyl-5-methyl and, in particular, 3-benzyl-5-carboxymethyl tetrahydro-1,3,5-thiadiazine, are also suitable as additional antimicrobial agents.

Formaldehyde-aminoalcohol condensates may also be used. These products are obtained by reacting an aqueous solution of formaldehyde with aminoalcohols, for example 2-aminoethanol, 1-amino-2-propanol, 2-aminoisobutanol, and 2-(2'-aminoethyl)-aminoethanol. Formaldehyde-glycol condensates are also suitable.

TESTS

The following tests were carried out to demonstrate the synergistic effect of the combination of the claimed compounds:

The surfactant combination to be tested for its cleaning effect is applied to an artificially soiled plastic surface. The artificial soil used is a mixture of carbon black, machine oil, a saturated fatty acid triglyceride and a low-boiling aliphatic hydrocarbon. The 26×28 cm test area is uniformly coated with 2 g of the artificial soil using a surface coater.

A plastic sponge is impregnated with quantities of 12 ml of the cleaner solution to be tested and moved mechanically over the test area. After six wiping movements, the cleaned test area is held under running water and the loose soil removed. The cleaning effect, i.e. the whiteness of the plastic surface thus cleaned, is measured by means of a Dr. B. Lange LF 90 photoelectric colorimeter. The clean, white plastic surface serves as the whiteness standard. Since, during the measurement, the clean surface is adjusted to 100% and the soiled area is indicated by 0, the values read off have to be equated with the percentage cleaning power (% CP) for the cleaned plastic surfaces. The % CP values quoted are the average values of 4 measurements.

Aqueous solutions of a mixture of (a) adducts of 9 and 12 moles of ethylene oxide with epoxides having a linear $C_{10-14}$ alkyl chain reacted with 1 mole of diethanolamine and (b) linear alkylbenzene sulfonates or linear alkane sulfonates were used in the following tests. The surfactants (a) and (b) are mixed in a ratio of from 10:0 to 0:10. The concentration of the test solutions was 10 g/l.

TEST 1

Mixtures of the adduct of 9 moles of ethylene oxide (EO) with internal $C_{11-14}$ epoxide reacted with diethanolamine (i-$C_{11-14}$ hydroxyamine+9 EO) and the sodium salt of linear $C_{11-14}$ alkylbenzene sulfonate (ABS) were used in this test and tested for their cleaning power (% CP).

| Surfactant mixture | Ratio | Concentration | % CP |
|---|---|---|---|
| (i-$C_{11-14}$—hydroxyamine + 9 EO):ABS | 10:0 | 10 g/l | 49 |
| (i-$C_{11-14}$—hydroxyamine + 9 EO):ABS | 8:2 | 10 g/l | 60 |
| (i-$C_{11-14}$—hydroxyamine + 9 EO):ABS | 5:5 | 10 g/l | 65 |
| (i-$C_{11-14}$—hydroxyamine + 9 EO):AS | 3:7 | 10 g/l | 80 |
| (i-$C_{11-14}$—hydroxyamine + 9 EO):ABS | 2:8 | 10 g/l | 70 |
| (i-$C_{11-14}$—hydroxyamine + 9 EO):ABS | 1:9 | 10 g/l | 65 |
| (i-$C_{11-14}$—hydroxyamine + 9 EO):ABS | 0:10 | 10 g/l | 59 |

The % CP value for water (blank value with tap water) was 16%. The test data show that the mixtures of i-$C_{11-14}$-hydroxyamine+9 EO and ABS in a ratio of from 5:5 to 1:9 have a synergistic cleaning effect.

TEST 2

Combinations of the adduct of 12 moles of ethylene oxide with internal $C_{11-14}$ epoxide reacted with diethanolamine (i-$C_{11-14}$-hydroxyamine+12 EO) and the sodium salts of linear $C_{11-14}$ alkylbenzene sulfonate (ABS) are used in test 2.

| Surfactant mixture | Ratio | Concentration | % CP |
|---|---|---|---|
| (i-$C_{11-14}$—hydroxyamine + 12 EO):ABS | 10:0 | 10 g/l | 52 |
| (i-$C_{11-14}$—hydroxyamine + 12 EO):ABS | 8:2 | 10 g/l | 60 |
| (i-$C_{11-14}$—hydroxyamine + 12 EO):ABS | 5:5 | 10 g/l | 62 |
| (i-$C_{11-14}$—hydroxyamine + 12 EO):AS | 3:7 | 10 g/l | 82 |
| (i-$C_{11-14}$—hydroxyamine + 12 EO):ABS | 2:8 | 10 g/l | 75 |
| (i-$C_{11-14}$—hydroxyamine + 12 EO):ABS | 1:9 | 10 g/l | 68 |
| (i-$C_{11-14}$—hydroxyamine + 12 EO):ABS | 0:10 | 10 g/l | 59 |

The % CP value for water was 15%. In these tests, the 3:7, 2:8 and 1:9 mixtures produced a synergistic increase in cleaning power.

TEST 3

Mixtures of the adduct of 9 moles of ethylene oxide with terminal $C_{12-14}$ epoxide reacted with diethanolamine and the sodium salt of linear $C_{11-14}$ alkylbenzene sulfonate were tested for their cleaning power.

| Surfactant mixture | Ratio | Concentration | % CP |
|---|---|---|---|
| (Alpha-$C_{12-14}$—hydroxyamine + 9 EO):ABS | 10:0 | 10 g/l | 50 |
| (Alpha-$C_{12-14}$—hydroxyamine + 9 EO):ABS | 8:2 | 10 g/l | 62 |
| (Alpha-$C_{12-14}$—hydroxyamine + 9 EO):ABS | 5:5 | 10 g/l | 65 |
| (Alpha-$C_{12-14}$—hydroxyamine + 9 EO):AS | 3:7 | 10 g/l | 82 |
| (Alpha-$C_{12-14}$—hydroxyamine + 9 EO):ABS | 2:8 | 10 g/l | 83 |
| (Alpha-$C_{12-14}$—hydroxyamine + 9 EO):ABS | 1:9 | 10 g/l | 73 |
| (Alpha-$C_{12-14}$—hydroxyamine + 9 EO):ABS | 0:10 | 10 g/l | 59 |

The % CP value for water was 15%. The results of these tests also show a synergistic effect in the case of the 5:5 to 1:9 mixtures.

TEST 4

Mixtures of the adduct of 12 moles of ethylene oxide with terminal $C_{12-14}$ epoxide reacted with diethanolamine and the sodium salt of linear $C_{11-14}$ alkylbenzene sulfonate (ABS) are used in test 4.

| Surfactant mixture | Ratio | Concentration | % CP |
|---|---|---|---|
| (Alpha-$C_{12-14}$—hydroxyamine + 12 EO):ABS | 10:0 | 10 g/l | 55 |
| (Alpha-$C_{12-14}$—hydroxyamine + 12 EO):ABS | 8:2 | 10 g/l | 64 |
| (Alpha-$C_{12-14}$—hydroxyamine + 12 EO):ABS | 5:5 | 10 g/l | 73 |
| (Alpha-$C_{12-14}$—hydroxyamine + 12 EO):AS | 3:7 | 10 g/l | 85 |
| (Alpha-$C_{12-14}$—hydroxyamine + 12 EO):AS | 2:8 | 10 g/l | 86 |
| (Alpha-$C_{12-14}$—hydroxyamine + 12 EO):ABS | 1:9 | 10 g/l | 77 |
| (Alpha-$C_{12-14}$—hydroxyamine + 12 EO):ABS | 0:10 | 10 g/l | 59 |

The % CP value for water was 14%. The synergistic effect is apparent in the case of and between the 5:5 and 1:9 mixtures.

EXAMPLE 1

| | |
|---|---|
| 8% | by weight of sodium dodecylbenzene sulfonate |
| 1% | by weight of i-$C_{11-14}$—hydroxyamine + 12 EO |
| 4% | by weight of sodium tripolyphosphate |
| 3% | by weight of sodium cumene sulfonate |
| 0.1% | by weight of polyglycol |
| 0.2% | by weight of perfume oil |
| 0.0015% | by weight of dye |

Remainder: water

EXAMPLE 2

| | |
|---|---|
| 7.5% | by weight of sodium dodecylbenzene sulfonate |
| 1.5% | by weight of i-$C_{11-14}$—hydroxyamine + 9 EO |
| 1.5% | by weight of potassium soap of soya oil fatty acid |
| 6% | by weight of sodium tripolyphosphate |
| 5% | by weight of propylene glycol monomethylether |
| 4% | by weignt of sodium cumene sulfonate |
| 0.8% | by weight of pine oil |
| 0.4% | by weight of Perfume oil |
| 0.003% | by weight of dye |

Remainder: water

EXAMPLE 3

| | |
|---|---|
| 9% | by weight $C_{11-14}$ alkane sulfonate, Na salt |
| 1% | by weight of alpha-$C_{12-14}$—hydroxyamine + 9 EO |
| 3% | by weight of ethylene diamine tetraacetic acid, Na salt |
| 4% | by weight of sodium cumene sulfonate |
| 5% | by weight of ethanol |
| 0.3% | by weight of perfume oil |

Remainder: water

EXAMPLE 4

| | |
|---|---|
| 8% | by weight of sodium dodecylbenzene sulfonate |
| 1.5% | by weight of alpha-$C_{12-14}$—hydroxyamine + 8 EO |
| 1.5% | by weight of soda |
| 5% | by weight of ethanol |
| 0.15% | by weight of polyglycol |
| 6% | by weight of urea |
| 0.1% | by weight of 2',4,4'-trichloro-2-hydroxydiphenyl-ether |
| 0.2% | by weight of perfume oil |
| 0.002% | by weight of dye |

Remainder: water

EXAMPLE 5

4% by weight of sodium dodecylbenzene sulfonate

-continued

| | |
|---|---|
| 3% | by weight of $C_{11-14}$ alkane sulfonate, Na salt |
| 1.5% | by weight of i-$C_{11-14}$—hydroxyamine + 10 EO |
| 5% | by weight of sodium cumene sulfonate |
| 4% | by weight of sodium tripolyphosphate |
| 6% | by weight of dipropylene glycol monomethylether |
| 2% | by weight of O—phenylphenol |
| 0.4% | by weight of perfume oil |
| 0.001% | by weight of dye |

Remainder: water

EXAMPLE 6

| | |
|---|---|
| 7% | by weight of sodium dodecylbenzene sulfonate |
| 1% | by weight of alpha-$C_{12-14}$—hydroxyamine + 12 EO |
| 3% | by weight of sodium tripolyphosphate |
| 6% | by weight of propylene glycol monoethylether |
| 7% | by weig$t of formaldehyde-aminoethanol condensate |
| 5% | by weight of sodium cumene sulfonate |
| 0.35% | by weight of perfume oil |
| 0.002% | by weight of dye |

Remainder: water

EXAMPLE 7

| | |
|---|---|
| 1.7% | by weight of sodium hydroxide (50%) |
| 7% | by weight of dodecylbenzene sulfonic acid |
| 1.5% | by weight of alpha-$C_{12-14}$—hydroxyamine + 12 EO |
| 4.5% | by weight of sodium tripolyphosphate |
| 3.5% | by weight of sodium cumene sulfonate |
| 4% | by weight of propylene glycol monoethylether |
| 0.25% | by weight of perfume oil |
| 0.002% | by weight of dye |

Remainder: water

The liquid cleaners according to the present invention preferably have formulations within the following limits:

| | |
|---|---|
| 4 to 9% | weight of $C_{11-14}$ alkylbenzene sulfonate and/or C12–C18 alkane sulfonate |

-continued

| | |
|---|---|
| 0.5 to 3% | by weight of $C_{11-14}$—hydroxy amine + (9–12) EO |
| 0 to 3% | by weight of $C_{12-18}$ fatty acid alkali or ammonium salt |
| 2 to 5% | by weight of sodium tripolyphosphate |
| 3 to 6% | by weight of dipropylene glycol monomethylether |
| 0 to 0.2% | by weight of polyglycol |
| 0.5 to 2% | by weight of pine oil |
| 2 to 4% | by weight of sodium cumene sulfonate |
| 0.2 to 0.6% | by weight of perfume oil |
| 0.0005 to 0.005% | by weight of dye; remainder: water |

The pH-value of the products of this prototype formulation is between about 8.0 and 11.

What is claimed is:

1. A liquid preparation for cleaning hard surface materials comprising:

(a) from 6 to 9% by weight of at least one anionic surfactant selected from the group consisting of $C_{11-14}$ alkylbenzene sulfonate and $C_{12-18}$ alkane sulfonate;

(b) from 0.5 to 3% by weight of the reaction product of a $C_{11-14}$-aliphatic visual hydroxyamine and 3 to 20 moles of ethylene oxide;

(c) from 0 to 3% by weight of a $C_{11-12}$ fatty acid alkali or ammonium salt;

(d) from 2.5 to 6% by weight of sodium tripolyphosphate;

(e) from 3 to 6% by weight of dipropylene glycol monoethylether;

(f) from 0 to 0.2% by weight of polyglycol;

(g) from 0.5 to 2% by weight of pine oil;

(h) from 2 to 4% by weight of sodium cumene sulfonate;

(i) from 0.2 to 0.6% by weight of perfume oil;

(j) from 0.0005 to 0.005% by weight of dyes; and the remainder water, all weights being based on the weight of said preparation.

2. A method of cleaning a hard surface comprising the step of contacting said surface with a liquid preparation as recited in claim 1.

* * * * *